US009871307B2

(12) United States Patent
Le Cam et al.

(10) Patent No.: US 9,871,307 B2
(45) Date of Patent: Jan. 16, 2018

(54) CONNECTOR FOR COUPLING COAXIAL CABLE TO STRIP LINE

(71) Applicant: Nokia Shanghai Bell Co., Ltd., Shanghai (CN)

(72) Inventors: Patrick Le Cam, Lannion (FR); Thomas Julien, Lannion (FR); Lin Yu, Shanghai (CN)

(73) Assignee: Nokia Shanghai Bell Co., Ltd, Shanghai (CN)

( * ) Notice: Subject to any disclaimer, the term of this patent is extended or adjusted under 35 U.S.C. 154(b) by 0 days.

(21) Appl. No.: 15/102,943

(22) PCT Filed: Nov. 26, 2014

(86) PCT No.: PCT/CN2014/092264
§ 371 (c)(1),
(2) Date: Jun. 9, 2016

(87) PCT Pub. No.: WO2015/085865
PCT Pub. Date: Jun. 18, 2015

(65) Prior Publication Data

US 2016/0308291 A1 Oct. 20, 2016

(30) Foreign Application Priority Data

Dec. 9, 2013 (CN) ..... 2013 1 0659556

(51) Int. Cl.
*H01R 9/05* (2006.01)
*H01R 4/02* (2006.01)
(Continued)

(52) U.S. Cl.
CPC ..... *H01R 9/0515* (2013.01); *H01P 5/085* (2013.01); *H01R 4/024* (2013.01); *H01R 12/53* (2013.01);
(Continued)

(58) Field of Classification Search
CPC .... H01R 4/024; H01R 4/90515; H01R 12/53; H01R 2103/00; H01R 2201/02;
(Continued)

(56) References Cited

U.S. PATENT DOCUMENTS 3,539,966 A * 11/1970 Logan ..... H01P 5/085 333/238
3,553,607 A * 1/1971 Lehrfeld ..... H01P 5/085 333/238
(Continued)

FOREIGN PATENT DOCUMENTS

CN 2559124 Y 7/2003
CN 1574450 A 2/2005
(Continued)

OTHER PUBLICATIONS

International Search Report for PCT/CN2014/092264 dated Mar. 2, 2015.

*Primary Examiner* — Tulsidas C Patel
*Assistant Examiner* — Travis Chambers
(74) *Attorney, Agent, or Firm* — Fay Sharpe, LLP

(57) ABSTRACT

A connector for coupling a coaxial cable (240) to a strip line comprises a first plate (210) to be arranged above a conductor (220) of the strip line to which a center conductor (244) of the coaxial cable (240) is soldered, the first plate (210) including: a first solder portion (212) to which a braid (242) of the coaxial cable (240) is soldered; and an aperture (214) formed adjacent to the first solder portion (212) and configured to prevent heat propagation of a solder point of the first solder portion (212) and the braid (242) of the coaxial cable (240) and to expose a solder point of the conductor (220) of the strip line and the center conductor (244) of the coaxial cable (240), wherein a biggest dimen-
(Continued)

sion of the aperture (214) is shaped to be less than 5% of highest frequency wavelength.

9 Claims, 6 Drawing Sheets

(51) Int. Cl.
*H01R 12/53* (2011.01)
*H01P 5/08* (2006.01)
*H01R 103/00* (2006.01)

(52) U.S. Cl.
CPC ..... *H01R 2103/00* (2013.01); *H01R 2201/02* (2013.01)

(58) Field of Classification Search
CPC ..... H01R 12/79; H01R 24/50; H01P 5/085; Y10S 439/916
USPC ..... 439/63, 495, 581, 916
See application file for complete search history.

(56) References Cited

U.S. PATENT DOCUMENTS 3,662,318 A * 5/1972 Decuyper ..... H01P 5/085 333/238
3,725,829 A 4/1973 Brown
4,280,112 A * 7/1981 Eisenhart ..... H01P 5/085 333/21 R
4,335,364 A * 6/1982 Schmitz ..... H01P 5/085 333/238
4,487,999 A * 12/1984 Baird ..... G02B 6/4248 174/50.55
4,906,957 A * 3/1990 Wilson ..... H01P 1/00 333/246
5,268,700 A * 12/1993 Hirotsu ..... H01Q 1/1271 343/713
5,404,117 A * 4/1995 Walz ..... H01P 5/085 333/260
5,517,747 A 5/1996 Pierro et al.
5,532,659 A * 7/1996 Dodart ..... H01R 9/0515 333/260
5,613,859 A * 3/1997 Bellantoni ..... H01P 5/085 333/260
5,738,529 A * 4/1998 Wedell ..... H01Q 1/00 343/906
5,823,790 A * 10/1998 Magnuson ..... H01R 24/50 333/260
6,065,976 A * 5/2000 Wang ..... H01R 24/50 439/581
6,126,453 A 10/2000 Gomez et al.
6,457,979 B1 * 10/2002 Dove ..... H01R 9/0515 439/63
6,468,089 B1 * 10/2002 Hubbard ..... H01R 23/6873 439/328
6,572,407 B1 6/2003 Ko
6,682,354 B2 * 1/2004 Carson ..... H01R 9/0515 439/581
6,847,276 B2 * 1/2005 Tamaki ..... H01P 5/085 333/260
6,894,590 B2 * 5/2005 Dove ..... H01P 5/085 29/825
6,980,068 B2 * 12/2005 Miyazawa ..... H01P 1/047 333/246
7,008,265 B2 * 3/2006 Jonsson ..... H01R 9/0515 439/581
7,029,321 B2 * 4/2006 Sato ..... H01R 9/0515 439/516
7,048,547 B2 * 5/2006 Gottwald ..... H01R 24/50 439/581
7,690,922 B2 * 4/2010 Huang ..... H01R 9/0515 439/63
7,782,273 B2 * 8/2010 Morikawa ..... H01P 5/085 343/711
8,035,466 B2 10/2011 Payne
8,449,305 B2 * 5/2013 Harel ..... H01P 3/085 439/63
8,704,725 B2 * 4/2014 Xu ..... H01P 5/085 343/700 MS
2001/0043127 A1 11/2001 Tanji
2002/0000932 A1 * 1/2002 Metzen ..... H01P 3/085 343/700 MS
2002/0177332 A1 * 11/2002 Hubbard ..... H01R 23/6873 439/63
2004/0057220 A1 3/2004 Tamaki et al.
2005/0068250 A1 * 3/2005 Cornec ..... H01Q 1/12 343/906
2005/0245129 A1 * 11/2005 Sato ..... H01R 9/0515 439/578
2006/0255877 A1 11/2006 Jiang et al.
2007/0054510 A1 * 3/2007 Price ..... H01R 24/50 439/63
2009/0015495 A1 * 1/2009 Yoshie ..... H01Q 1/325 343/713
2009/0059540 A1 * 3/2009 Giboney ..... H05K 9/0056 361/739
2009/0197434 A1 * 8/2009 Kressner ..... H01R 12/57 439/63
2011/0217853 A1 * 9/2011 Cornic ..... H01P 5/085 439/63
2014/0153211 A1 * 6/2014 Malek ..... H01Q 1/38 361/809
2015/0311605 A1 * 10/2015 Moore ..... H01R 12/53 439/84

FOREIGN PATENT DOCUMENTS

CN 1760788 Y 4/2006
CN 201629411 U 11/2010
CN 102099873 A 6/2011
CN 202231185 U 5/2012
CN 203225416 U 10/2013
CN 103647127 A 3/2014
CN 203617413 U 5/2014
EP 1 936 734 A 6/2008
JP H08293358 A 11/1996
JP H 8-340207 12/1996
JP 2001-320208 11/2001
JP 2009-290043 A 12/2009
JP 2012-518963 8/2012
WO WO 2006/011768 2/2006
WO WO 2014173318 10/2014

* cited by examiner

CONNECTOR FOR COUPLING COAXIAL CABLE TO STRIP LINE

FIELD OF THE INVENTION

The present invention generally relates to an electronic connector, and particularly to a connector for coupling a coaxial cable to a strip line.

BACKGROUND OF THE INVENTION

Base station antennas are built with arrays of several radiating elements, which are connected to a distribution network (e.g., power dividers, phase shifters, etc.) with transmission lines. Typically, the transmission lines are coaxial cables, and the distribution network are made with strip line devices due to high performances of the strip lines (e.g., good insertion losses, reasonable dimensions, good shielding of the lines, etc.). Specifically, referring to FIG. 1, the radiating elements of base station antennas are connected to the strip lines 112 of the strip line device 110 with coaxial cables 114, wherein the stripe lines 112 are arranged between the cover plate 116 and bottom plate 118 of the strip line device 110.

Several configurations of coaxial cable to strip line interfaces already exist, which mainly comprises two families:

In the first family, the center conductor of the coaxial cable is soldered to the strip line conductor. The braid of the coaxial cable is soldered on an interface part. This interface part is connected to the strip line cover and bottom plates using screws or studs with nuts assemblies. For this family, the potential problems with the interface are:

- PIM (Passive Inter Modulation) level variation with screws torque stability;
- If there is a problem in the contact with center conductors of the coaxial cable and strip line, the strip line cover must be removed to be able to repair, for example, to check or re-solder the center conductors.

In the second family, to remove the PIM potential problems due to screws torque variation, the center conductors of the coaxial cable and the strip line are still soldered together, but the coaxial cable braid is also directly soldered to the strip line plates, using special shapes of the plates. In this case, plates are made from material with good soldering capability (e.g., brass, copper, tin plated steel, etc.). For this family, the problems linked to the configuration are:

- Difficulties to obtain a good solder with the plates due to heat diffusion across huge area around soldering point;
- If there is a problem with the solder of the center conductors, the cover must be removed to repair. As all connection points are soldered, it is even harder to remove the cover than in the first family where it was screwed. Generally, the unsoldered cover has big deformations and must be scrapped and replaced, which is additional cost in labor time and material.

OBJECT AND SUMMARY OF THE INVENTION

Based on above concerns, it would be advantageous to achieve a connector for coupling a coaxial cable to a strip line, which could improve soldering capability between the braid of the coaxial cable and the cover plate of the strip line and allow the conductor of the strip line and the center conductor of the coaxial cable to be re-soldered without disassembling.

One embodiment of the invention provides a connector for coupling a coaxial cable to a strip line, the connector comprising:

a first plate to be arranged above a conductor of the strip line to which a center conductor of the coaxial cable is soldered, the first plate including:

- a first solder portion to which a braid of the coaxial cable is soldered; and
- an aperture formed adjacent to the first solder portion, configured to prevent heat propagation of a solder point of the first solder portion and the braid of the coaxial cable and to expose a solder point of the conductor of the strip line and the center conductor of the coaxial cable, wherein a biggest dimension of the aperture is shaped to be less than 5% of highest frequency wavelength.

With the aperture formed adjacent to the first solder portion, a heat break is created to prevent heat propagation of the solder point of the first solder portion and the braid of the coaxial cable to a huge area and thus the soldering capability between the braid of the coaxial cable and the first plate (e.g., the cover plate of the strip line) could be achieved. Furthermore, as the solder point of the conductor of the strip line and the center conductor of the coaxial cable is exposed, the conductor of the strip line and the center conductor of the coaxial cable could be allowed to be re-soldered without disassembling.

With the aperture formed on the first plate (e.g., the cover plate of the strip line), the degradation of impedance of the coaxial cable to strip line interface occurs, advantageously, a portion, which is under the aperture, of the conductor of the strip line is shaped to compensate impedance degradation caused by the aperture. For example, the portion of the conductor of the strip line may be widened to compensate the impedance degradation.

Advantageously, the aperture is formed over the solder point of the conductor of the strip line and the center conductor of the coaxial cable.

Advantageously, the first solder portion comprises two solder pads, and the aperture is formed between the two solder pads.

Advantageously, a second solder portion of a second plate is soldered to the first solder portion of the second plate, the second solder portion having a hole through which the coaxial cable is passed and the braid of the coaxial cable being soldered to the second solder portion.

Advantageously, the aperture is of rectangle shape.

Advantageously, the first plate is a cover plate of the strip line, and the second plate is a bottom plate of the strip line.

BRIEF DESCRIPTION OF THE DRAWINGS

The above and other objects and features of the present invention will become more apparent from the following detailed description considered in connection with the accompanying drawings, in which.

Throughout the above drawings, like reference numerals will be understood to refer to like, similar or corresponding features or functions.

DETAILED DESCRIPTION

In the following detailed description of the preferred embodiments, reference is made to the accompanying drawings that form a part hereof. The accompanying drawings show, by way of illustration, specific embodiments in which the disclosure may be practiced. The illustrated embodiments are not intended to be exhaustive of all embodiments according to the disclosure. It is to be understood that other embodiments may be utilized, and structural or logical changes may be made without departing from the scope of the disclosure. The following detailed description, therefore, is not to be taken in a limiting sense, and the scope of the invention is defined by the appended claims.

In the following Detailed Description, reference is made to the accompanying drawings, which form a part hereof, and in which is shown by way of illustration specific embodiments in which the invention may be practiced. In this regard, directional terminology, such as "left", "right", "top," "bottom," "front," "back," "leading," "forward," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Hereinafter, for illustrative purposes only, the connector for coupling a coaxial cable to a strip line of the invention will be described using the base station antennas as one example of its application scenario; however those skilled in the art could appreciate that the connector can be used in any application scenario where coaxial cables and strip lines are used.

Figure 1:
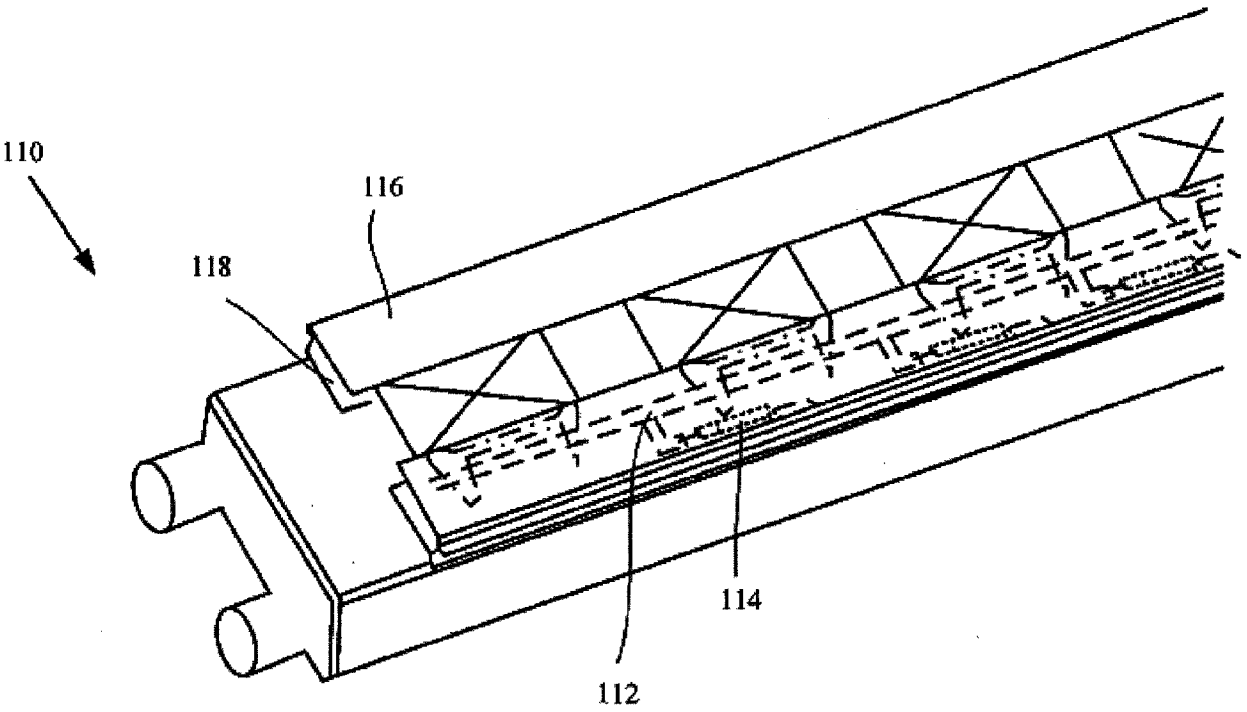
FIG. 1 (Prior Art)
FIG. 1 shows an isometric view of a strip line device with coaxial cable connected to the strip line.
Figure 2A:
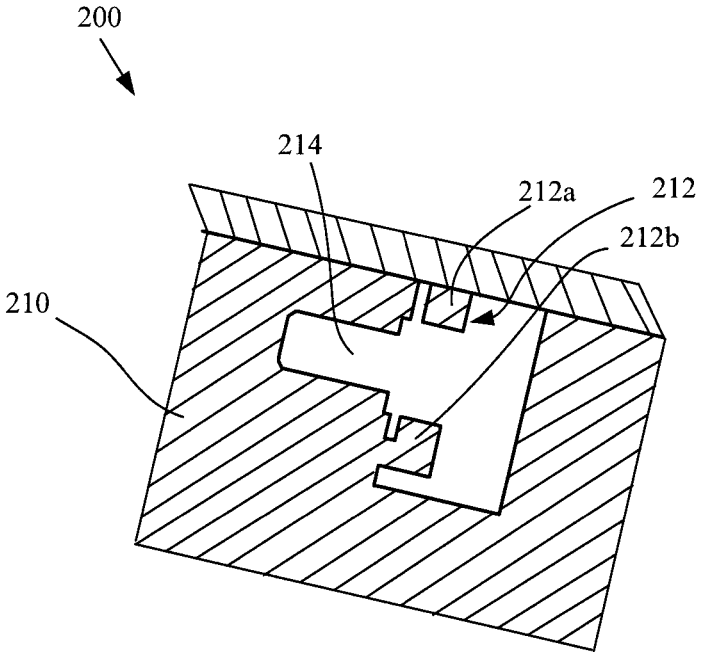
FIG. 2*a* shows an isometric view of a first plate according to one embodiment of the invention.
Figure 2B:
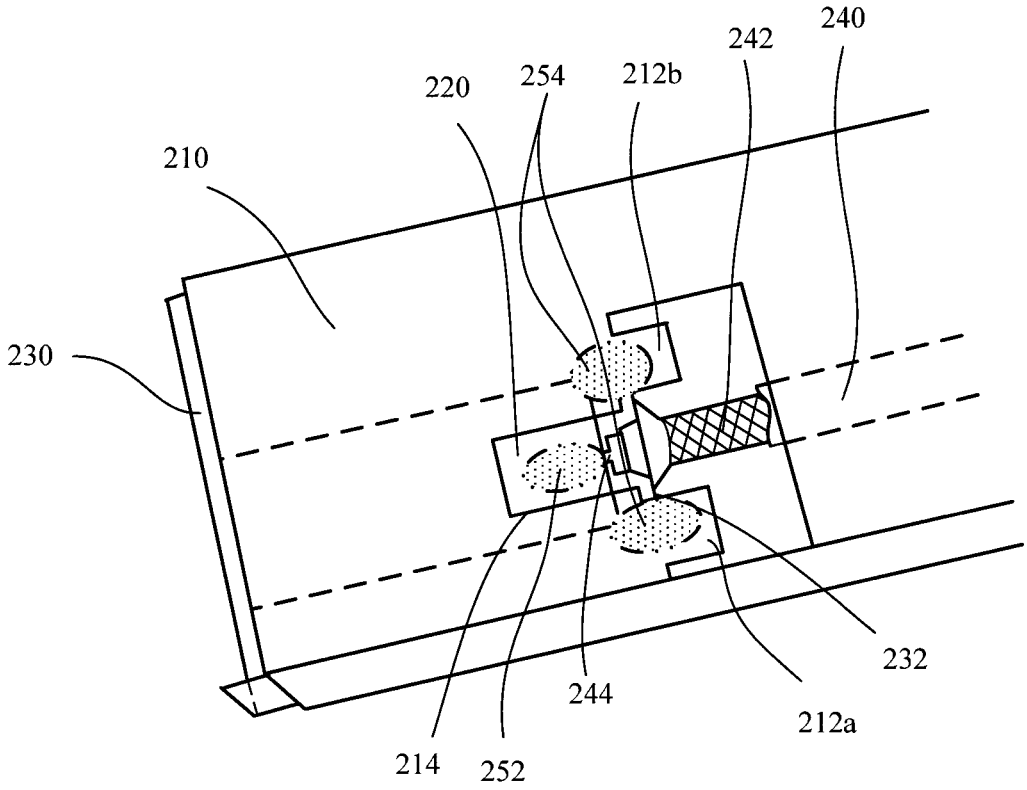
FIG. 2*b* shows an isometric view of a first plate with coaxial cable connected to the strip line according to one embodiment of the invention.

Referring to FIGS. 2*a* and 2*b*, the exemplary connector 200 of the invention includes a first plate 210 having a first solder portion 212 and an aperture 214 formed adjacent to the first solder portion 212. The first plate 210 may be a portion of the cover plate of the strip line, or be the entire cover plate of the strip line, for example. In an alternative example, the first plate 212 may be a separate part to be mounted on the cover plate of the strip line.

The first solder portion 212 can be of any suitable configuration, but generally include two solder pads 212*a* and 212*b*, and the aperture 214 is typically formed between the two solder pads 212*a* and 212*b*, as shown in FIG. 2*a*.

Still referring to FIG. 2*b*, the conductor 220 of the strip line is arranged between the first plate 212 (e.g. the cover plate of the strip line) and the second plate 230 (e.g. the bottom plate of the strip line). The second solder portion 232 of the second plate 230 is soldered to the first solder portion 212 of the first plate 210 and also has a hole (not shown) formed thereon for the coaxial cable to pass therethrough. During the assembly, the coaxial cable 240 passes through the hole of the second solder portion 232 with its braid 242 soldered to the second solder portion 232 and its center conductor 244 soldered to the conductor 220 of the strip line.

Since the aperture 214 is formed adjacent to the first solder portion 212, a heat break is created to prevent heat propagation of the solder point 254 of the first solder portion 212 of the cover plate of the strip line and the braid 242 of the coaxial cable (and thus the second solder portion 232 of the bottom plate of the strip line) to a huge area and thus the soldering capability between the braid of the coaxial cable and the cover plate of the strip line could be achieved.

Advantageously, the aperture 214 may be formed over the solder point 252 of the conductor 220 of the strip line and the center conductor 244 of the coaxial cable 240 to expose the solder point 252. As such, the conductor 220 of the strip line and the center conductor 244 of the coaxial cable 240 could be allowed to be re-soldered without disassembling.

To achieve the purpose of preventing heat propagation of the solder point 254 and exposing the solder point 252 for re-soldering, the aperture 214 may be of any suitable shape, for example, rectangle, circle, ellipse, trapezium, triangle, etc. Moreover, to consider that the radiation of the aperture 214 could be negligible at the operating frequency, the biggest dimension of the aperture 214 is shaped to be less than 5% of the highest frequency wavelength of the base station antennas.

Figure 3:
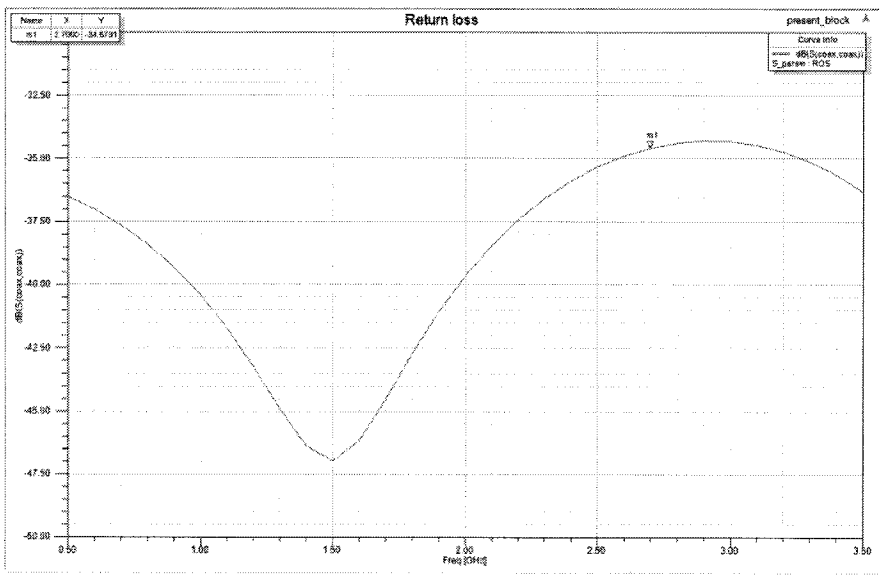
FIG. 3 shows a schematic view of a coaxial cable to strip line interface without aperture and its return loss.
Figure 3:
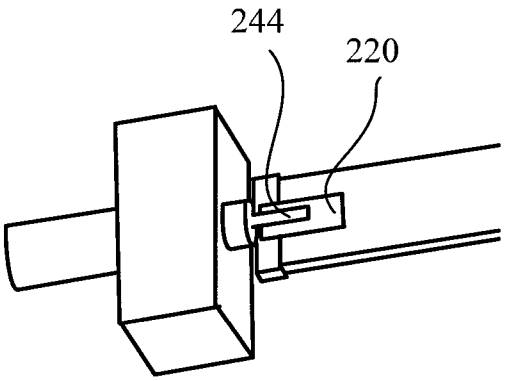
Figure 4:
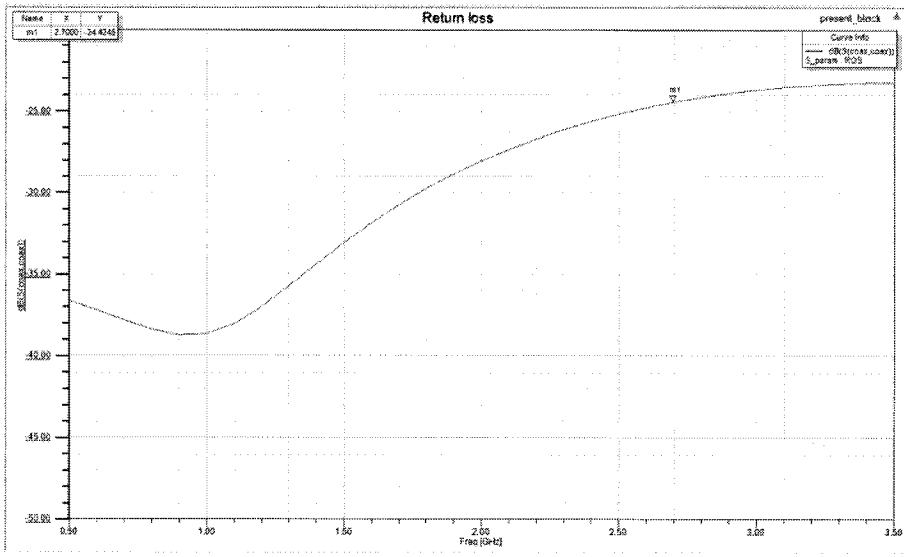
FIG. 4 shows a schematic view of a coaxial cable to strip line interface with aperture and its return loss.
Figure 4:
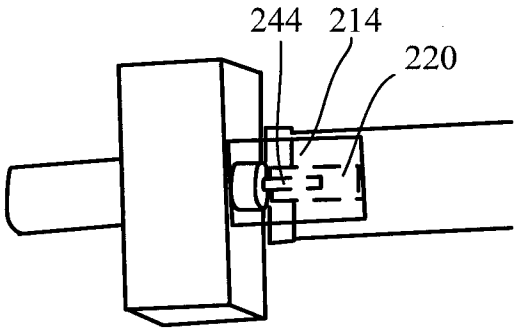
Figure 5:
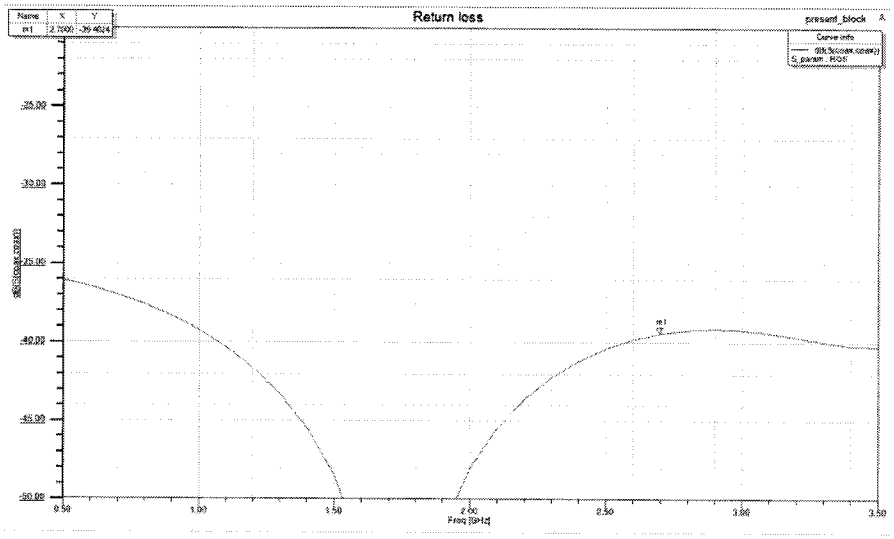
FIG. 5 shows a schematic view of a coaxial cable to strip line interface with aperture and compensation and its return loss.
Figure 5:
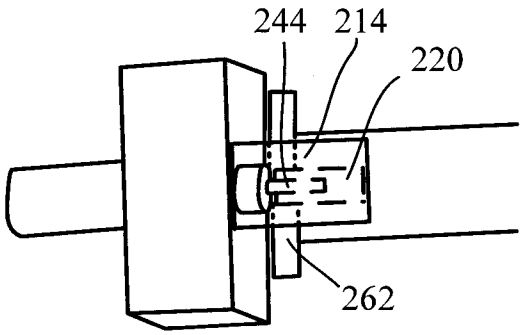

With the aperture 214 formed on the cover plate of the strip line, the degradation of impedance of the coaxial cable to strip line interface occurs, for example the return loss is degraded to 23 dB as shown in FIG. 4, which is 10 dB degradation compared to the conventional configuration without aperture as shown in FIG. 3 (33 dB, HFSS simulation results). In this regard, advantageously, a portion 262, which is under the aperture 214, of the conductor 220 of the strip line is shaped to compensate impedance degradation caused by the aperture. For example, the portion of the conductor 220 of the strip line may be widened to compensate the impedance degradation. With proper optimization of the shape of the conductor 220 of the strip line, it is possible to obtain good impedance for the coaxial cable to strip line interface with return loss better than 35 dB, as shown in FIG. 5.

It should be noted that the above described embodiments are given for describing rather than limiting the invention, and it is to be understood that modifications and variations may be resorted to without departing from the spirit and scope of the invention as those skilled in the art readily understand. Such modifications and variations are considered to be within the scope of the invention and the appended claims. The protection scope of the invention is defined by the accompanying claims. In addition, any of the reference numerals in the claims should not be interpreted as a limitation to the claims. Use of the verb "comprise" and its conjugations does not exclude the presence of elements or steps other than those stated in a claim. The indefinite article "a" or "an" preceding an element or step does not exclude the presence of a plurality of such elements or steps.

What is claimed is:

1. A connector for coupling a coaxial cable to a strip line, the connector comprising:

a first plate to be arranged above a conductor of the strip line, wherein the conductor of the strip line and a center conductor of the coaxial cable are soldered, the first plate including:

a first solder portion to which a braid of the coaxial cable is soldered; and an aperture formed adjacent to the first solder portion, configured to prevent heat propagation of a solder point of the first solder portion and the braid of the coaxial cable and to expose a solder point of the conductor of the strip line and the center conductor of the coaxial cable, wherein a biggest dimension of the aperture is shaped to be less than 5% of highest frequency wavelength.

2. The connector of claim 1, wherein the aperture is formed over the solder point of the conductor of the strip line and the center conductor of the coaxial cable.

3. The connector of claim 1, wherein the first solder portion comprises two solder pads, and the aperture is formed between the two solder pads.

4. The connector of claim 1, wherein the aperture is of rectangle shape.

5. The connector of claim 1, wherein the first plate is a cover plate of the strip line.

6. The connector of claim 1, further comprising the conductor of the strip line, wherein a portion, which is under the aperture, of the conductor of the strip line is shaped to compensate impedance degradation caused by the aperture.

7. The connector of claim 6, wherein the portion of the conductor of the strip line is widened to compensate the impedance degradation.

8. The connector of claim 1, wherein a second solder portion of a second plate is soldered to the first solder portion of the first plate, and the braid of the coaxial cable is soldered to the second solder portion.

9. The connector of claim 8, wherein the second plate is a bottom plate of the strip line.

* * * * *